US007922514B2

(12) United States Patent
Liao

(10) Patent No.: US 7,922,514 B2
(45) Date of Patent: Apr. 12, 2011

(54) SOCKET CONNECTOR HAVING ADJUSTABLE ALIGNING ARRANGEMENT

(75) Inventor: Fang-Jwu Liao, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/626,514

(22) Filed: Nov. 25, 2009

(65) Prior Publication Data

US 2010/0130047 A1 May 27, 2010

(30) Foreign Application Priority Data

Nov. 25, 2008 (TW) ..... 97221060 U

(51) Int. Cl.
*H01R 13/64* (2006.01)

(52) U.S. Cl. ..... 439/378; 439/756

(58) Field of Classification Search ..... 439/378, 439/526, 593, 542, 756
See application file for complete search history.

(56) References Cited

U.S. PATENT DOCUMENTS

| | | | | |
|---|---|---|---|---|
| 5,055,055 | A * | 10/1991 | Bakker | 439/78 |
| 5,575,691 | A * | 11/1996 | Matthews | 439/744 |
| 6,007,360 | A * | 12/1999 | Wu et al. | 439/350 |
| 6,659,795 | B1 * | 12/2003 | Lai et al. | 439/526 |
| 6,705,892 | B2 * | 3/2004 | Kim | 439/542 |
| 7,377,791 | B2 | 5/2008 | Liao et al. | |
| 7,547,216 | B1 * | 6/2009 | Polnyl et al. | 439/68 |
| 7,553,088 | B2 * | 6/2009 | Nakajima | 385/64 |
| 7,581,963 | B2 | 9/2009 | Liao | |
| 2006/0068629 | A1 * | 3/2006 | Nakajima | 439/378 |
| 2009/0017671 | A1 * | 1/2009 | Liao | 439/378 |
| 2010/0130047 | A1 * | 5/2010 | Liao | 439/296 |

* cited by examiner

*Primary Examiner* — James Harvey

(74) *Attorney, Agent, or Firm* — Andrew C. Cheng; Wei Te Chung; Ming Chieh Chang

(57) ABSTRACT

An electrical connector (1) includes an insulative housing (2) defining a plate-like shape with at least one alignment hole (21) extending therethrough in a vertical direction, and a number of electrical contacts (3) secured in the insulative housing (2). A number of spring ribs (211) are integrally formed on the insulative housing (2) and extend into the alignment hole (21). The spring ribs (211) deform in radial direction and circumferential direction of the alignment hole for engaging with an alignment post (41).

15 Claims, 4 Drawing Sheets

SOCKET CONNECTOR HAVING ADJUSTABLE ALIGNING ARRANGEMENT

BACKGROUND OF THE INVENTION

1. Field of the Invention

The present invention relates to a socket connector, and more particularly, to a socket connector having collapsible alignment hole for readily engaging with an aligning pin.

2. Description of the Prior Art

An electrical connector disclosed in U.S. Pat. No. 7,581,963 issued to Liao on Sep. 1, 2009 includes an insulative housing made of plastic with a plate-like shape and comprising a top surface for confronting a CPU (central processing unit) and a bottom surface for being assembled to a PCB (printed circuit board). The housing also defines alignment holes extending therethrough in a vertical direction. A plurality of spring ribs each extends into the alignment hole in a cantilevered manner with a gap between the rib and a corresponding area of an inner face of the alignment hole. As an alignment pin is inserted and engages with the rib, it pushes the rib toward the corresponding area. The alignment pin exerts a circumferential force to the spring ribs and makes the spring ribs deformed, similarly the deformation of the spring ribs exerts a counterforce to the alignment pin so that the alignment pin is securely retained within the alignment hole. However, since the spring ribs have a cantilevered configuration and may easily lose its flexibility and encountered a permanent deformation. As a result, the alignment pin can not be securely retained therein.

In view of the above, an improved electrical connector that overcomes the above-mentioned disadvantages is desired.

SUMMARY OF THE INVENTION

Accordingly, an object of the present invention is to provide an electrical connector which has improved alignment and positioning structure for a post received therein.

To fulfill the above-mentioned object, an electrical connector comprises a planar insulative housing defining at least one alignment hole extending therethrough in a vertical direction, and a plurality of electrical contacts secured in the insulative housing. Pluralities of spring ribs are integrally formed on the insulative housing and extend into the alignment hole. Each spring rib connects with the insulative housing at opposite sides thereof and defines a closed orifice with the insulative housing. The orifice penetrates the insulative housing.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
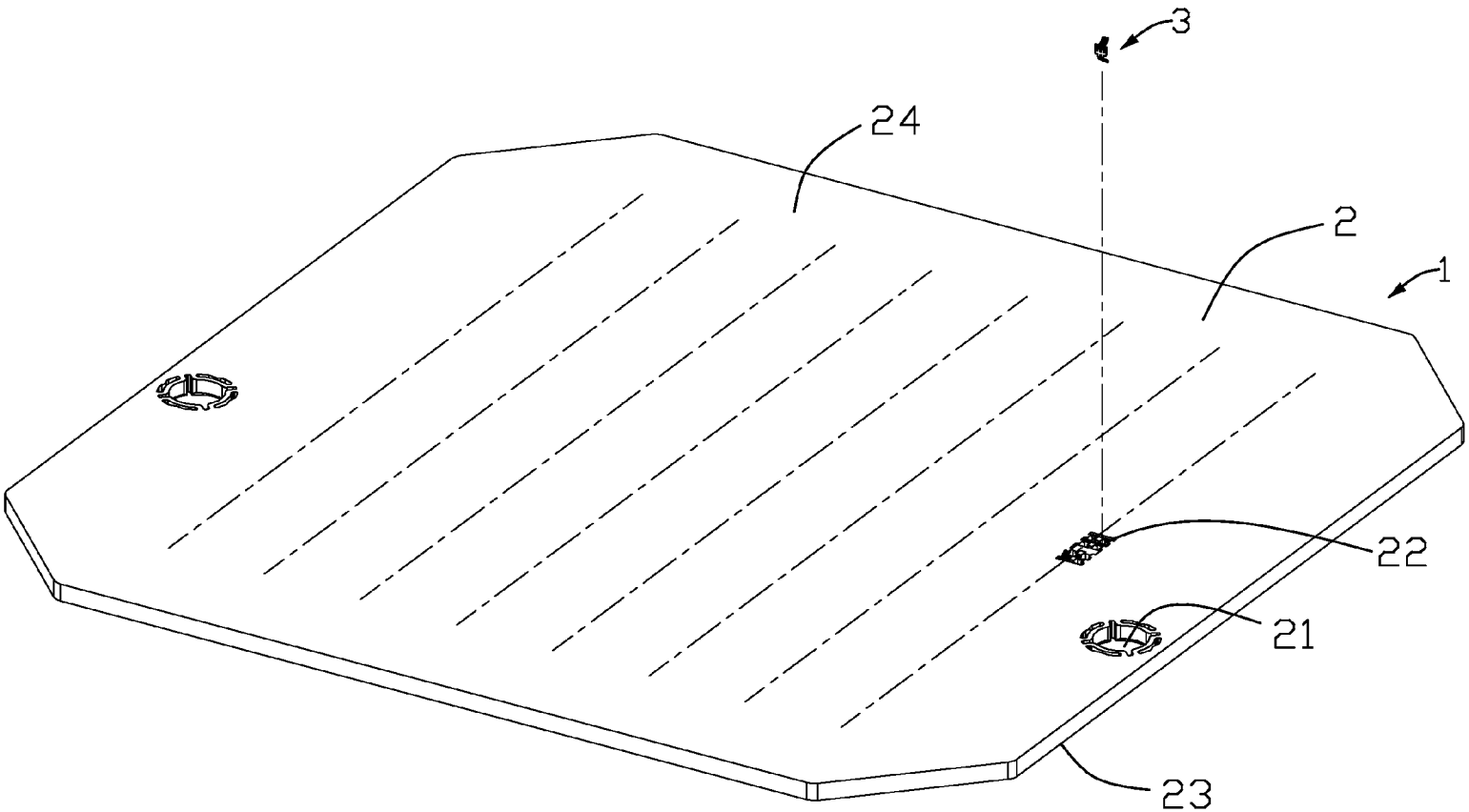
FIG. 1 is an exploded, perspective view of an electrical connector of the present invention.
Figure 2:
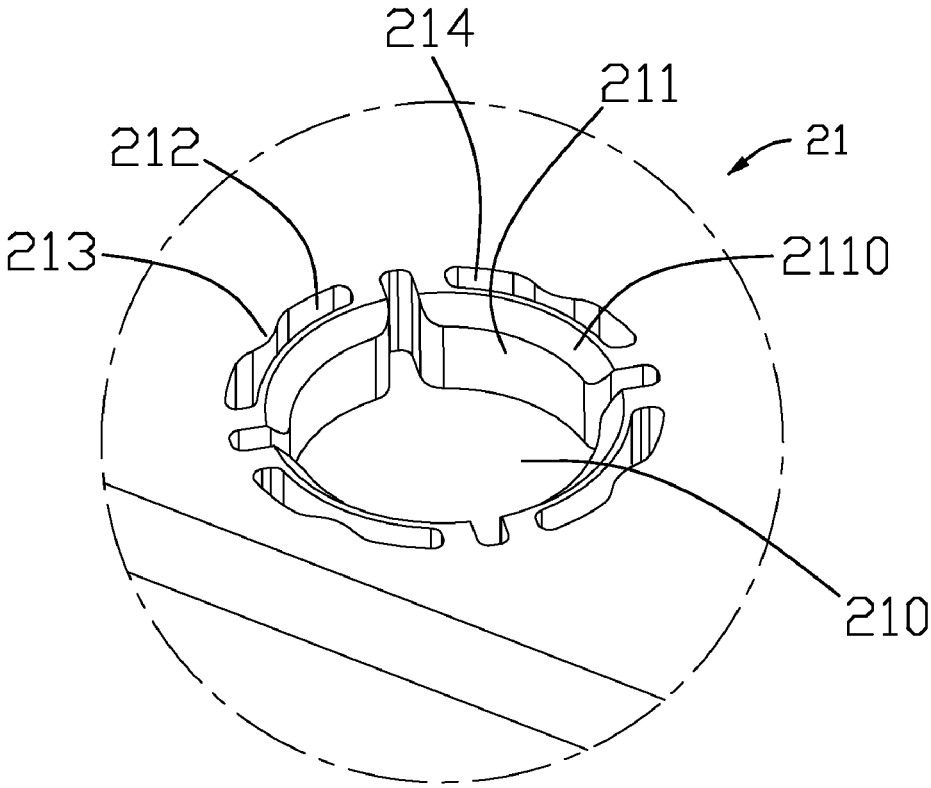
FIG. 2 is an enlarged, perspective view of an alignment hole of the electrical connector shown in FIG. 1.
Figure 3:
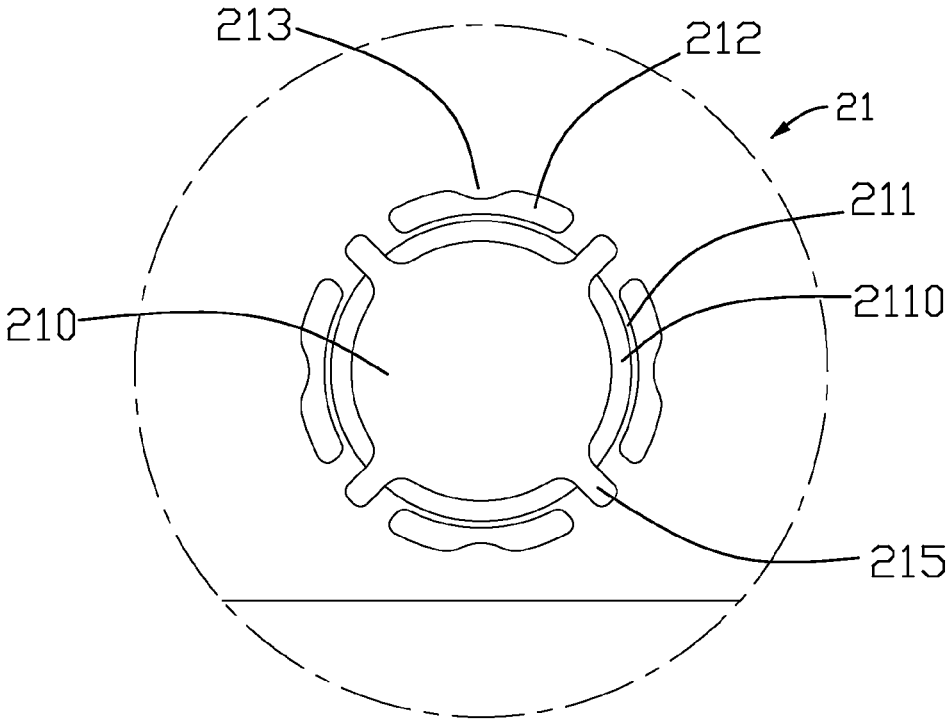
FIG. 3 is a top view of the alignment hole shown in FIG. 2.
Figure 4:
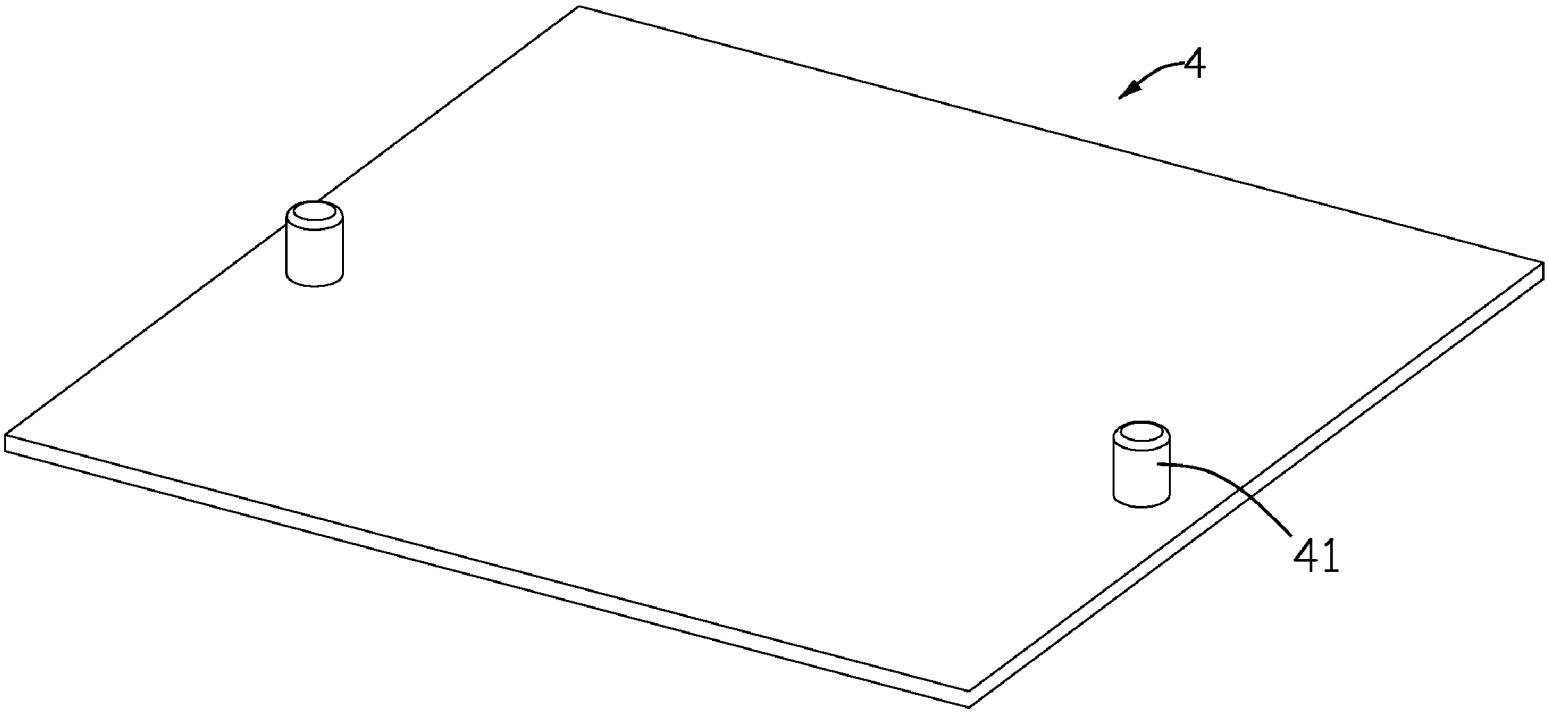
FIG. 4 is a perspective view of an electronic package for connecting with the electrical connector shown in FIG. 1.

Referring to FIGS. 1 to 4, an electrical connector 1 for electrically connecting an electronic package 4, such as a central processing unit (CPU), with a circuit substrate (not shown), such as a printed circuit board (PCB) comprises an insulative housing 2 and a plurality of electrical contacts 3.

The planar insulative housing 2 is made of plastic and comprises an upper surface 24 for supporting the electronic package 4 and a bottom surface 23 for facing to the PCB. The top surface 24 defines a plurality of passageways 22 extending through the insulative housing 2 for receiving the contacts 3. The insulative housing 2 also defines two circular alignment holes 21 extending therethrough in a vertical direction.

A plurality of spring ribs 211 are integrally formed on the insulative housing 2 and extend into the alignment hole 21. The spring rib 211 is perpendicular to the upper and bottom surfaces 24, 23 of the insulative housing 2 and has a lead-in face 2110 at an upper end thereof. Each spring rib 211 connects with the alignment hole 21 at opposite sides thereof and defines an orifice 212 with the insulative housing 2. The orifice 212 penetrates the insulative housing 2. An emboss 213 extends from an inner surface 214 of the orifice 212 and protrudes into the orifice 212. Each spring rib 211 forms a cylindrical surface perpendicular to the bottom surface 23 of the insulative housing 2, thereby forming a central through hole 210. The spring ribs 211 are symmetrically arranged on the circumference of the alignment hole 21 with a clearance 215 between adjacent ribs 211 communicating with the central through hole 210.

The electronic package 4 has alignment posts 41 corresponding to the alignment hole 21. The guiding face 2110 of the spring rib 211 guides the alignment post 41 going through the central through hole 210 of the alignment hole 21. After the alignment post 41 is inserted into the alignment hole 21, the alignment post 41 exerts a force to the spring ribs 211 and makes the spring ribs 211 to deform in radial direction and circumferential direction of the alignment hole 21, similarly the deformation of the spring rib 211 exerts counterforce to the alignment post 41 so that the alignment post 41 is securely retained in the alignment hole 21, thus the electronic package 4 is securely positioned on the insulative housing 2. Meanwhile, the diameter of the alignment post 41 is larger than the central through hole 210. The emboss 213 supports the spring rib 211 so as to avoid the spring rib 211 being overly distorted. The spring rib 211 has a same height with the insulative housing 2 also increasing the intensity thereof.

The alignment post 41 can apply to fix the electrical connector 1 with the electronic package 4. It also can apply to fix the electronic package 4, the electrical connector 1 and the PCB simultaneously or fix the electrical connector 1 and the PCB. The alignment post 41 also can be a discrete element rather than formed on the package 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a planar insulative housing defining at least one alignment hole extending therethrough in a vertical direction; and a plurality of electrical contacts secured in the insulative housing; wherein a plurality of spring ribs are integrally formed on the insulative housing and extending into the alignment hole, each spring rib connecting with the insulative housing at opposite sides thereof and defining an orifice with the insulative housing, said orifice penetrating the insulative housing;

wherein an emboss extends from the insulative housing and protrudes into the orifice.

2. An electrical connector comprising:

an insulative housing with at least one alignment hole extending therethrough in a vertical direction for receiving a post therein; and a plurality of contact received in the insulative housing; wherein a plurality of spring ribs extend from the insulative housing and engaging with the post, the spring ribs deforming in radial direction and circumferential direction of the alignment hole after the post is inserted into the alignment hole; wherein a clearance essentially extends in a radial direction with regard to the alignment hole.

3. The electrical connector as claimed in claim 1, wherein each spring rib is perpendicular to upper and bottom surfaces of the insulative housing.

4. The electrical connector as claimed in claim 3, wherein each spring rib has a lead-in face at an upper end thereof.

5. The electrical connector as claimed in claim 1, wherein each rib forms a cylindrical surface perpendicular to the bottom surface of the insulative housing.

6. The electrical connector as claimed in claim 1, wherein the ribs are symmetrically arranged on the circumference of the alignment hole with a clearance between adjacent ribs.

7. The electrical connector as claimed in claim 1, wherein a clearance is formed between every adjacent two ribs in a circumference region of the alignment hole for allowing circumferential deformation of the rib.

8. The electrical connector as claimed in claim 7, wherein said clearance essentially extends in a radial direction with regard to the alignment hole.

9. The electrical connector as claimed in claim 2, wherein said clearance is formed between every adjacent two ribs in a circumference region of the alignment hole for allowing circumferential deformation of the rib.

10. The electrical connector as claimed in claim 2, wherein the spring rib and the insulative housing define an orifice on the radial direction of the alignment hole.

11. The electrical connector as claimed in claim 10, wherein the spring ribs are spaced from each other along the circumferential direction of the alignment hole.

12. The electrical connector as claimed in claim 10, wherein an emboss extends from the insulative housing and supports the spring rib after the post being inserted into the alignment hole.

13. The electrical connector as claimed in claim 2, wherein the spring rib has same height with the insulative housing.

14. The electrical connector as claimed in claim 2, wherein each rib forms a cylindrical surface perpendicular to a bottom surface of the insulative housing.

15. The electrical connector as claimed in claim 2, wherein the ribs are symmetrically arranged on the circumference of the alignment hole.

* * * * *